US009637924B2

(12) United States Patent
Comerford

(10) Patent No.: US 9,637,924 B2
(45) Date of Patent: May 2, 2017

(54) REINFORCING

(71) Applicant: MB Couplers Pty Ltd, Victoria (AU)

(72) Inventor: Ernest Comerford, Glen Alplin (AU)

(73) Assignee: MB Couplers Pty Ltd, Victoria (AU)

( * ) Notice: Subject to any disclaimer, the term of this patent is extended or adjusted under 35 U.S.C. 154(b) by 0 days.

(21) Appl. No.: 14/748,552

(22) Filed: Jun. 24, 2015

(65) Prior Publication Data

US 2015/0354216 A1 Dec. 10, 2015
US 2016/0237685 A9 Aug. 18, 2016

Related U.S. Application Data

(63) Continuation of application No. 13/101,476, filed on May 5, 2011, now Pat. No. 9,068,349, which is a continuation-in-part of application No. 11/883,785, filed as application No. PCT/AU2006/000163 on Feb. 8, 2006, now Pat. No. 8,123,429, said application No. 13/101,476 is a continuation of
(Continued)

(30) Foreign Application Priority Data

Feb. 8, 2005 (AU) ..... 2005900557
Nov. 6, 2008 (AU) ..... 2008905736

(51) Int. Cl.

| | |
|---|---|
| ***E04C 5/00*** | (2006.01) |
| ***E04C 5/16*** | (2006.01) |
| ***B21F 15/08*** | (2006.01) |
| ***C21D 7/10*** | (2006.01) |
| ***E04C 5/01*** | (2006.01) |
| *C21D 9/50* | (2006.01) |

(52) U.S. Cl.
CPC ..... *E04C 5/165* (2013.01); *B21F 15/08* (2013.01); *C21D 7/105* (2013.01); *E04C 5/01* (2013.01); *C21D 9/50* (2013.01)

(58) Field of Classification Search
CPC ..... E04C 5/165
USPC ..... 403/311, 339, 364, 393
See application file for complete search history.

(56) References Cited

U.S. PATENT DOCUMENTS

| | | | |
|---|---|---|---|
| 53,219 | A | 3/1866 | Fawcett |
| 295,559 | A | 3/1884 | Kitson |
| 709,400 | A | 9/1902 | Fitzpatrick |

(Continued)

FOREIGN PATENT DOCUMENTS

| | | | |
|---|---|---|---|
| CN | 1124812 | A | 6/1996 |
| DE | 8206277 | U1 | 8/1982 |

(Continued)

OTHER PUBLICATIONS

Derwent Abstract Accession No. 97-513541/48, Class Q44, CN 1124812 A (Yang), Jun. 19, 1996, Abstract.

(Continued)

*Primary Examiner* — Victor MacArthur
(74) *Attorney, Agent, or Firm* — The Webb Law Firm

(57) ABSTRACT

Reinforcing is disclosed comprising a reinforcing bar extending along a portion of the length of the reinforcing and a termination extending along an end portion of the reinforcing. The termination may have a body extending in a longitudinal direction and a lateral engagement face formed on the body. The engagement face may incorporate locking formations thereon arranged to interfit with a complementary shaped termination to form an interlock arranged to accommodate loading applied in the longitudinal direction.

22 Claims, 7 Drawing Sheets

Related U.S. Application Data application No. PCT/AU2009/001448, filed on Nov. 6, 2009.

(56) References Cited

U.S. PATENT DOCUMENTS

| | | | |
|---|---|---|---|
| 867,312 | A | 10/1907 | Shutz |
| 1,003,973 | A | 9/1911 | Barrickman |
| 1,331,776 | A | 2/1920 | Lewis |
| 1,368,191 | A | 2/1921 | Nelson |
| 5,098,216 | A | 3/1992 | Caperton |
| 5,407,292 | A | 4/1995 | Collins |
| 5,439,309 | A | 8/1995 | Raz |
| 5,919,205 | A | 7/1999 | Heimberger et al. |
| 2003/0231925 | A1 | 12/2003 | Chen |

FOREIGN PATENT DOCUMENTS

| | | | |
|---|---|---|---|
| DE | 35040004 | A1 | 8/1986 |
| FR | 2580344 | A1 | 10/1986 |
| JP | 2003201751 | A | 7/2003 |
| WO | 9424447 | A1 | 10/1994 |

OTHER PUBLICATIONS

Derwent Abstract Accession No. 98-096117/09, Class Q44, JP 09324495 A, (Mitsutomo), Dec. 16, 1997.

REINFORCING

CROSS-REFERENCE TO RELATED APPLICATIONS

This application is a continuation of U.S. application Ser. No. 13/101,476 filed May 5, 2011, now U.S. Pat. No. 9,068,349, which is a continuation in part of U.S. application Ser. No. 11/883,785 filed Apr. 16, 2008, now U.S. Pat. No. 8,123,429, which is the United States national stage of International Application No. PCT/AU2006/000163, filed Feb. 8, 2006, which claimed priority to Australian Application No. 2005900557, filed Feb. 8, 2005. U.S. application Ser. No. 13/101,476 is also a continuation of PCT/AU2009/001448, filed Nov. 6, 2009, which claimed priority to Australian Application No. 2008905736, filed Nov. 6, 2008. The disclosures of these prior applications are incorporated herein in their entireties by reference.

TECHNICAL FIELD

The disclosure relates generally to reinforcing for concrete or other cementitious construction. In particular, the disclosure is directed to the coupling of reinforcing bars and is herein described in that context. However, it is to be appreciated that the disclosure has broader application and may be utilised in the coupling of a reinforcing bar to other rigid objects such as metal plates or the like.

BACKGROUND OF THE INVENTION

In the construction industry, structures (such as walls, floors, slabs and columns) of concrete are produced by positioning reinforcing such as steel reinforcing bars in a region where concrete is then poured to produce the structure. The bars are supported in desired positions and often there is a need to join length of bars to each other to ensure that the reinforcing not only is correctly positioned, but is able to transmit load across the coupling so that the bars can accommodate a large part or even their full axial capacity in either tension or compression.

In the past, wire ties or wraps have been secured around overlapping ends of adjacent bars to hold them relative to one another prior to the concrete pour.

Axial loads are transferred from one bar to the other overlapped bar through the concrete encasing the two joined bars. This method uses more bar than necessary as the overlapped length of bar is only useful to effect the transfer of axial loads and these overlapping lengths can form a significant mass of reinforcing bar in a structure.

In another arrangement, bars are formed with short externally threaded end portions and a sleeve with left handed and right handed internal thread portions is used to allow adjacent end of the bars to be connected to one another.

The formation of the external threaded portions on ends of the bars results in those ends being of less diameter than the remainder of the bar and thus is undesirable since engineering requirements may dictate that a bar having a predetermined diameter is used. One way to overcome this difficulty is to employ oversized bars. This ensures that the threaded end of the bar is still of a diameter equal to or greater than the diameter dictated by the engineering requirements. However, with this arrangement, most of the bars are of a gauge greater than is necessary.

Ideally the properties of the coupling, such as its axial capacity and its ductility, are at least the same as the major portion of the bars and that only limited longitudinal slip will occur when the coupling is loaded. If these properties are not within certain tolerances, then the coupling can significantly compromise the resulting structure. For example, if there is excessive longitudinal slip then this can cause excessive localised cracking thereby heightening the risk of corrosion, and may also cause excessive deflection. If the coupling is not as ductile as the main part of the bar, then this can cause localised stress concentration which potentially could result in catastrophic failure of the coupling.

The use of separate coupling elements, such as the threaded sleeve mentioned above, may be problematic where a construction site has reinforcing bars of different strength as there is a danger of a potential mismatch of the sleeve to the bars. Furthermore, the use of a threaded arrangement requires for there to be some play between the components to enable easy installation, which in turn may result in unacceptable longitudinal slip under load. Also there is an ongoing risk that the couplings are not adequately tightened on site which will compromise the coupling.

SUMMARY OF THE INVENTION

A termination for reinforcing is disclosed, the termination having a body extending in a longitudinal direction, and a lateral engagement face formed on the body, the engagement face incorporates locking formations thereon arranged to interfit with a complementary shaped termination to form an interlock arranged to accommodate loading applied in the longitudinal direction.

BRIEF DESCRIPTION OF THE DRAWINGS

It is convenient to hereinafter describe embodiments with reference to the accompanying drawings. It is to be appreciated however that the particularity of the drawings and the related description is to be understood as not limiting the preceding broad description.

DESCRIPTION OF THE INVENTION

Figure 1:
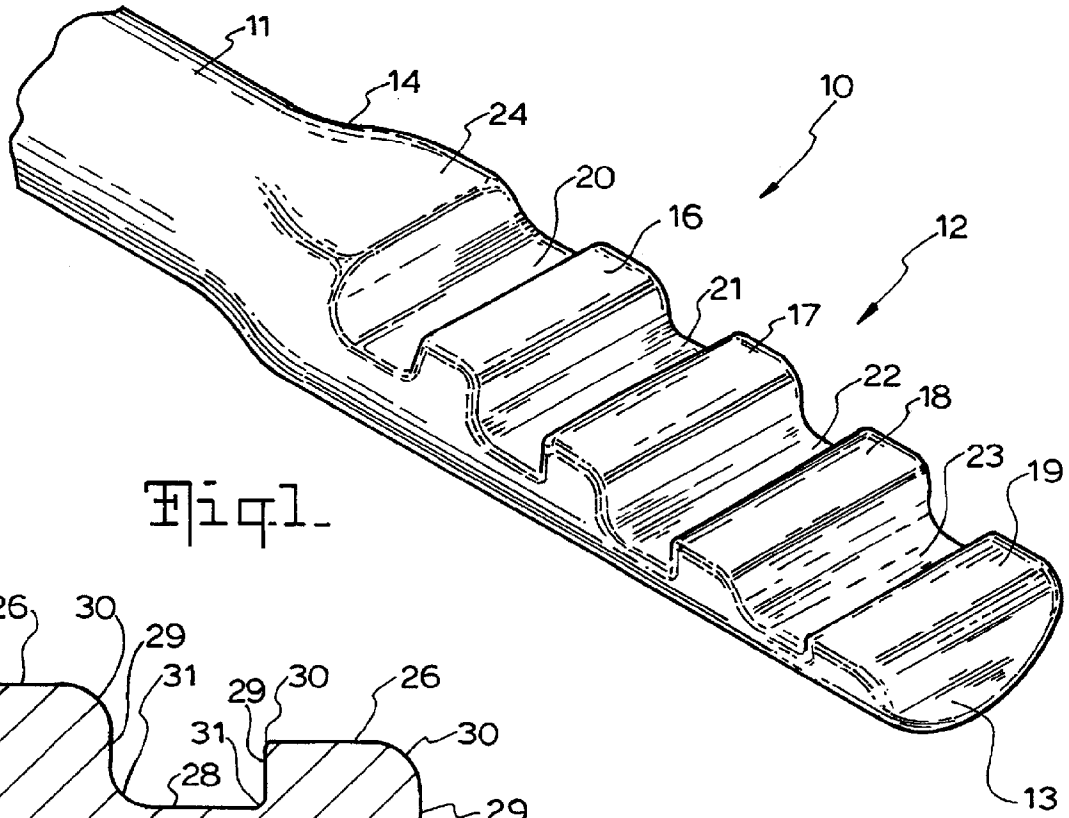
FIG. 1 is a partial perspective view of reinforcing showing a termination of the reinforcing on a reinforcing bar end.

In the following detailed description, reference is made to accompanying drawings which form a part of the detailed description. The illustrative embodiments described in the detailed description, depicted in the drawings and defined in the claims, are not intended to be limiting. Other embodiments may be utilized and other changes may be made without departing from the spirit or scope of the subject matter presented. It will be readily understood that the aspects of the present disclosure, as generally described herein and illustrated in the drawings can be arranged, substituted, combined, separated and designed in a wide variety of different configurations, all of which are contemplated in this disclosure.

Disclosed is a reinforcing bar comprising a shaft extending along a portion of the length of the bar and a termination extending along an end portion of the bar and being integrally formed with the shaft, the termination being enlarged as compared to the shaft and the termination incorporating an engagement face incorporating locking formations thereon arranged to interfit with a complementary shaped termination to form an interlock arranged to accommodate axial loading.

In the context of the specification, "axial loading" means loading that is applied in the direction that the termination extends so that the interlock is in tension or compression. Further, the term "interlock" means an arrangement where components are connected together in a manner that prevents separation under load in at least one direction, even if the components are free to separate under load in another direction.

In some embodiments, a reinforcing bar is provided which, by virtue of the termination, allows direct connection of the bar with another object, such as another reinforcing bar, having a complementary shaped termination. The advantage of this arrangement is that the integrity of the coupling is enhanced as it does not require the use of other components to transmit axial load across the interlock. Further, by making the terminations of appropriate size and shape, it is possible for the coupling to meet desired requirements for ductility and axial capacity. Also longitudinal slip under load can be maintained to acceptable levels.

In some embodiments, the termination has the same material properties as the shaft and is enlarged as compared to the bar shaft so that the interlock exhibits adequate performance characteristics (e.g. strength under axial load and ductility).

In some embodiments, the termination is made from a different material to the reinforcing bar shaft or from the same material as the shaft but with its material properties altered. In these latter arrangements, the termination may be the same size as the bar shaft, or smaller, or may be enlarged as in the earlier arrangement.

In some embodiments, the locking formations are profiled so that the interlock is arranged to accommodate substantially all of the axial load. In some embodiments, a retaining device may be utilised to retain the terminations in engagement, but this device is not necessarily designed to be placed under load on axial loading of the reinforcing. In a particular form, the locking formations are shaped so that the reaction force at the interlock under axial loading does not induce separation of the terminations.

Also disclosed is a termination, the termination having a body extending in a longitudinal direction between opposite first and second ends, and a lateral engagement face formed on the body, in use the first end is joined to an end of a reinforcing bar, and the engagement face incorporates locking formations thereon arranged to interfit with a complementary shaped termination to form an interlock arranged to accommodate loading applied in the longitudinal direction.

In one form, the termination is formed as a metal casting.

In some embodiments, the termination is made separately, preferably by a casting process, and then joined to the reinforcing bar. This has the advantage in that it can reduce the cost of equipment required to manufacture the reinforcing. Further, by permanently bonding the termination to a reinforcing bar, the resultant reinforcing can be of an integral form and can have the same attendant advantages as reinforcing formed by deforming an end of the reinforcing bar.

Also disclosed is reinforcing comprising a reinforcing bar extending along a portion of the length of the reinforcing, and a termination according to the above form extending along an end portion of the reinforcing, the termination being permanently bonded to the reinforcing bar.

In the context of the specification, the term "permanently" means that the components joined by bonding cannot be separated without causing destruction of the connection and/or the components.

In some embodiments, the first end of the termination is permanently bonded to an end of the reinforcing bar so that the termination and the reinforcing bar are joined in end to end relation.

In some embodiments, the termination is enlarged as compared to the bar. In some embodiments, a reference axis of the termination that extends between the first and second ends is aligned with an axis of the reinforcing bar. The alignment of these axes reduces eccentric loading on the termination so as to maintain axial loading at the interlock on tensioning of the reinforcing bar. In some embodiments, the termination may be arranged to be offset to the bar axis if required.

In some embodiments, the termination is fused to the shaft to form the permanent connection. In one form, a forging operation is used to bond the termination to the reinforcing bar. In one form, the bond is formed by welding.

In some embodiments, the termination is friction welded to the shaft. Friction welding involves a process where two components are forced together (under a friction or forge force) and are heated by mechanical friction of one component rubbing against the other (typically by rotating one component whilst holding the other component stationary). The heating by mechanical friction continues for sufficient time until the material softens and some shortening (upset) of the components occur under the friction force. The rotation driving force is then discontinued but the friction force is maintained or increased to fuse the materials together. Technically, because no melt occurs, friction welding is not actually a welding process in the traditional sense, but a forging technique.

An advantage of friction welding is that because of the direct heat input at the weld surface, it gives rise to relatively small heat affected zones. Also as there is no melting, no solidification defects occur. The resulting joints are of forge quality, with a complete butt joint weld through the contact area.

Also disclosed is a coupling for interconnecting first and second reinforcing bars, the coupling comprising: first and second terminations extending along an end portion of the first and second reinforcing bars respectively, at least one of the reinforcing bars having its termination integrally formed with a shaft of that reinforcing bar and being enlarged as compared to that shaft, each termination including an engagement face incorporating locking formations thereon, the engagement faces of the terminations being in opposing abutting relation with the locking formations interfitting to form an interlock; and a retaining device disposed around the interlock to retain the engagement faces in the opposing abutting relation to one another.

In some embodiments, the termination is shaped to form an interlock with a complementary termination of identical shape. As such, the first and second terminations are the same. Such an arrangement is beneficial in that it does not require the terminations to be handed thereby making it easier to install onsite.

In some embodiments, locking formations comprise a plurality of spaced apart upstands extending transversely across the engagement face and one or more recesses disposed between adjacent ones of the upstands. In use, the upstands and recesses interfit with upstands and recesses disposed on the complementary shaped termination to form the interlock.

In some embodiments, the upstands include opposite side walls that are interconnected by a bridging portion. Furthermore, the opposing side walls of adjacent ones of the upstands may define respective ones of the recesses.

In some embodiments, the side walls incorporate bearing surfaces which are arranged to interengage in formation of the interlock.

In some embodiments, the upstands are stepped downwardly along the engagement face towards the terminal end of the bar. This arrangement enables the loading to be distributed more evenly across the termination. In some embodiments, the upstands are of different size so as to facilitate correct location of the upstands into corresponding recesses of the other termination.

In some embodiments, in use, the coupling is able to accommodate axial loading which is at least equal to the axial capacity of the shafts of the reinforcing bars and exhibits increased ductility as compared to the bar shafts. In some situations, the coupling may be advantageously used to connect reinforcing that have different shaft diameters. This is commonly desirable in construction where the loading conditions change across the structure. Using the coupling of at least one embodiment of the present invention, this can be achieved by providing reinforcing having a termination which is typically oversized for that bar shaft but which is in complementary shape to reinforcing of the larger shaft diameter.

In some embodiments, the bearing surfaces extend generally normal to the direction of axial loading. With this arrangement the reaction forces applied in the coupling are contained within the terminations and there is no significant vector force that will load a surrounding retaining device under normal elastic loading conditions. Furthermore, by having the bearing surfaces generally normal to the direction of axial loading, the longitudinal slip within the coupling may be contained to acceptable limits without requiring the fit between the retaining device and the terminations being of a very tight tolerance to inhibit lateral movement of the interlocks. In this arrangement any lateral movement between the terminations (say for example that which may be possible due to the gap between the retaining device and the interlocked terminations) will not translate to a longitudinal displacement. Alternatively, the tight tolerance between the retaining device and the terminations may be provided through post forming of the retaining devices (e.g. when a sleeve is used, by forcing that sleeve over a mandrel) or by the use of packing, such as shims or the like in between the interlocking terminations and the retaining device. In this latter form, the slope of the bearing surfaces is not as critical.

In some embodiments, the bearing surfaces extend at an angle of within 10° to the perpendicular of the direction of axial loading and more preferably within an angle of 5° to the perpendicular.

In some embodiments the surrounding sleeve has a section modulus which is able to provide resistance to shear loading greater than the loading capacity of the reinforcing bar shaft. In this way, the couplings may be used when loaded as a shear connector.

Also disclosed is a method of connecting first and second reinforcing bars, the method comprising the steps: interconnecting first and second reinforcing bars by forming an interlock between terminations formed on the end of the reinforcing bars, In some embodiments, at least one of the reinforcing bars has its termination integrally formed with a shaft of that reinforcing bar and being enlarged as compared to that shaft, the interlock being formed by interfitting locking formations formed on the respective terminations; and providing a retaining device about the interlock to retain the locking formations in interfitting relation.

In some embodiments, the interlock extends along an axis and when connected, the reinforcing bars enable load to be transferred through the interlock in the direction of the interlock axis without inducing any substantial load on the retaining device.

In some embodiments wherein the first and second reinforcing bars are of identical shape, the method further comprising the step of facilitating proper mating of the reinforcing bars through having first upstands of the reinforcing bars extend in the longitudinal direction a distance greater than second upstands of the reinforcing bars.

Also disclosed is a method of forming reinforcing comprising the steps of providing a termination according to any form described above; and bonding the termination onto an end of a reinforcing bar so as to make the termination integral with the reinforcing bar.

In some embodiments, the termination is fused to the reinforcing bar.

In some embodiments, the termination is joined to the reinforcing bar by forging. In one form, the termination is welded to the reinforcing bar.

In some embodiments, the termination is friction welded to the reinforcing bar.

Accordingly, in some embodiments reinforcing is provided which incorporates a profiled termination bonded on an end of a reinforcing shaft. The termination may be made as a cast component thereby enabling it to be made to a requisite high standard under controlled conditions. The termination may be joined to standard reinforcing bar by a friction welding process using relatively inexpensive equipment and with only minimal if any pre-treatment of the reinforcing bar. The resultant reinforcing is of integral form and each stage of the process (i.e. casting and joining) can be adequately controlled so that a coupling utilising the reinforcing can provide the required properties of strength, ductility and longitudinal slip. Also, by making the termination separately from the reinforcing bar, the reinforcing can be produced without requiring the specialised equipment necessary to produce the termination by deforming the reinforcing bar end thereby reducing a constraint to manufacture of the product.

Figure 2:
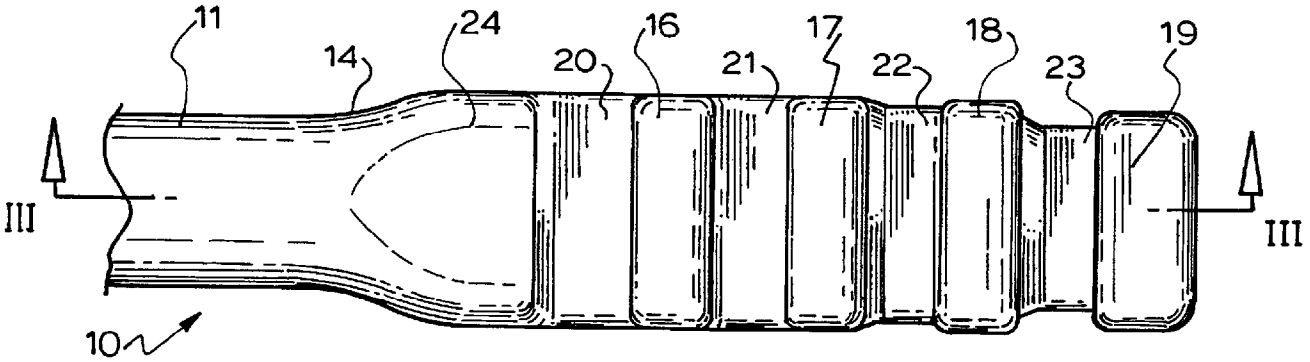
FIG. 2 is a plan view of the reinforcing of FIG. 1.
Figure 3:
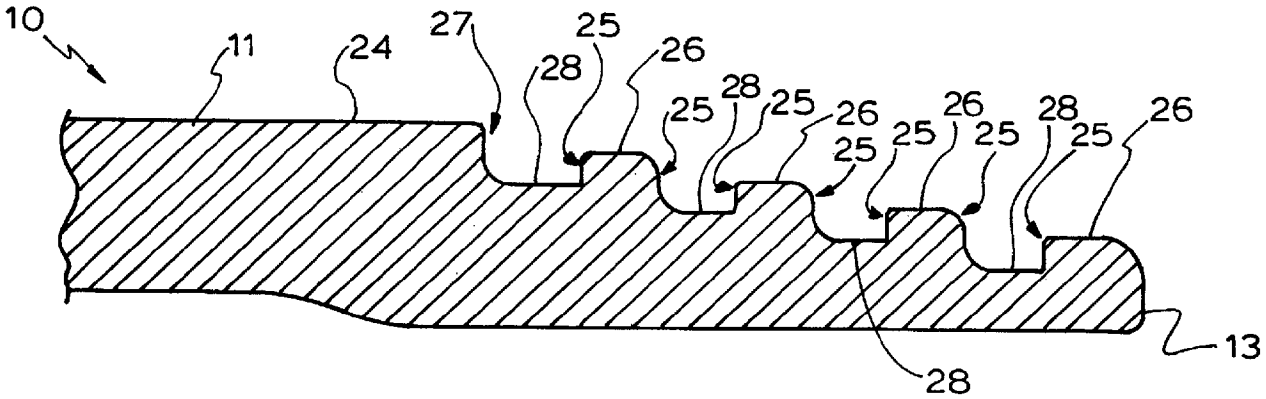
FIG. 3 is a sectional elevation of the reinforcing along section lines III-III of FIG. 2.

Turning firstly to FIGS. 1 to 3, a partial view of a reinforcing bar 10 is shown. The bar 10, which is typically made from steel, incorporates a shaft 11 which extends along the majority of the length of the bar 10. Whilst only a small portion of the shaft 11 is shown, it is to be appreciated that this shaft may extend for many meters. These bars are made in continuous lengths and are cut to size depending on the requirements of a particular job. Furthermore, for convenience, the shaft 11 as shown is plain. Again, it is to be appreciated that the shaft may include ribbing, and such bar is commonly referred to as deformed bar.

The reinforcing bar 10 further includes a termination 12 which extends along an end portion of the bar to the terminal end 13 of the reinforcing bar 10. In the illustrated form, the termination 12 is integrally formed with the shaft 11 and is enlarged as compared to that shaft (i.e. it extends radially outwardly from a central axis CL of the reinforcing bar a greater distance than the shaft). A transition zone 14 is present between the shaft 11 and the enlarged termination 12.

The enlarged termination 12 in the embodiment shown in FIGS. 1 to 3 is typically formed by deforming an end of the bar. In this arrangement, prior to formation, the whole of the bar 10 has a diameter corresponding to the diameter of the shaft 11.

The termination 12 includes a lateral engagement face 15 which extends along a length of the bar 10 and projects outwardly therefrom. This engagement face 15 is profiled to include locking formations which enables the bar 10 to be coupled to another bar or other object to form an interlock as will be discussed in more detail below. The locking formations in the illustrated form comprise a plurality of spaced apart upstands 16, 17, 18 and 19 and a plurality of recesses 20, 21, 22 and 23. The majority of these recesses 21, 22 and 23 extend between adjacent ones of the upstands (16, 17, 18 and 19). A proximal one of the recesses 20 extends between a hub portion 24 of the termination and its adjacent upstand 16.

As best illustrated in FIGS. 2 and 3, the termination is configured as a part cylinder having a diameter which is greater than the axis of the shaft 11. Furthermore, the engagement face 15 is formed effectively as a "cut out" from that cylindrical termination. However, it is to be appreciated that whist the engagement face 15 may be considered as a cut out portion, it is not limited to such a method of manufacturing as the termination may be formed into its final shape by a forging operation, casting operation or the like without the need for any substantial removal of material. Co-pending International application filed by the Applicant and entitled "A Method and Apparatus for Forming Metal Reinforcing" discloses processes for the manufacture of the reinforcing bar 10 using a forging operation, and the contents of this application are herein incorporated by cross reference. Reinforcing 70 using a cast termination 71 is disclosed in more detail below with reference to FIGS. 10 to 12.

As best illustrated in FIG. 3, each of the upstands (16, 17, 18 and 19) include opposite side walls 25 which are interconnected by bridging portions 26. Furthermore the hub portion 24 of the termination 12 includes a side wall 27. With this arrangement, the walls 25, 27 also act as the side walls for the recesses. Base portions 28 interconnect these adjacent side walls to form the base of the respective recesses (20, 21, 22, 23).

Figure 4:
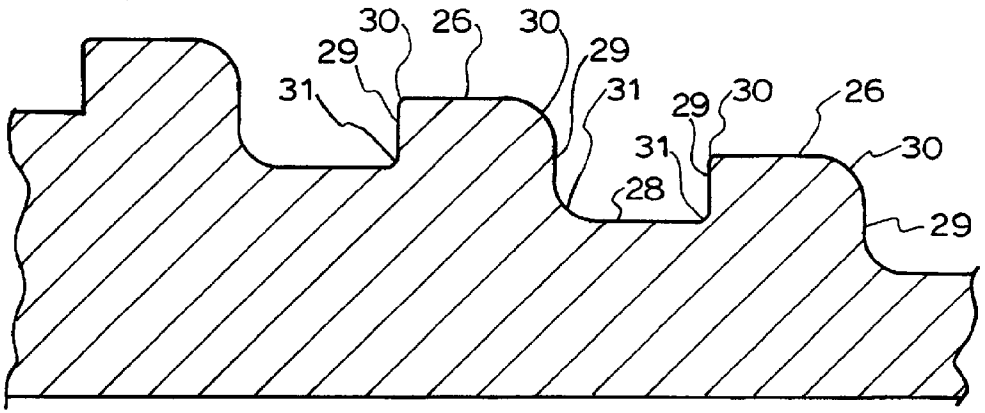
FIG. 4 is a detailed view to an enlarged scale of the locking formations on the termination of the reinforcing of FIG. 1.

The side walls 25 in the illustrated form are linear and extend across the entire engaging face 15. Further, the bridging portions 26 and the bases 28 are also formed as flat surfaces. As best illustrated in the enlarged view of FIG. 4, each of the side walls 25 is formed from three components. The first component is a bearing surface 29 which is disposed in a mid region of the side wall and which is normal to the centreline (CL) of the bar 10. A first transition region 30 is formed above the bearing surface 29 and forms the intersection between that bearing surface 29 and the bridging surface 26. A lower transition region 31 extends from the bearing surface 29 to the base portion 28. Both the upper and the lower transition regions (30 and 31) incorporate a radius with the radius of the top transition region 30 being smaller than the radius of the lower transition region 31.

The upstands and recesses of the engagement face 15 are shaped so that the termination 12 will form an interlock with a termination of the same shape.

The end upstand 19 adjacent the terminal end 13 of the bar 10 is wider than the other upstands. Further, the innermost recess 20 is also wider so as to be able to receive an upstand of the shape of the end upstand 19. This arrangement is provided so as to facilitate proper mating of the terminations in forming the interlock.

Finally, as best illustrated in FIG. 3, the upstands are arranged to step downwardly towards the terminal end 13. With this arrangement, the bearing faces 29 of the various upstands are not axially aligned but rather are at different radial spacings from the centreline CL. This is advantageous as it enables a more even distribution of stress through the termination when it is coupled to another termination.

Figure 5:
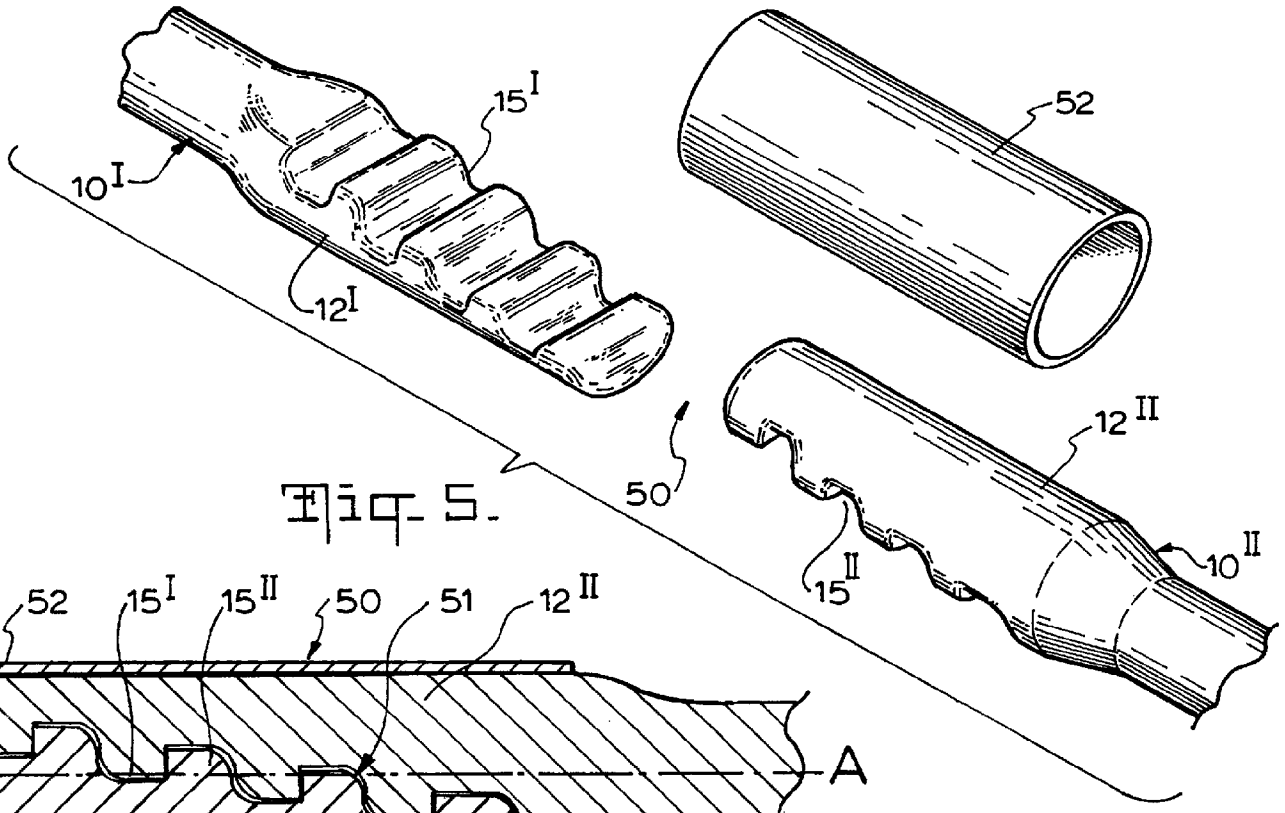
FIG. 5 is an exploded view showing the components of a coupling of reinforcing of FIG. 1.
Figure 6:
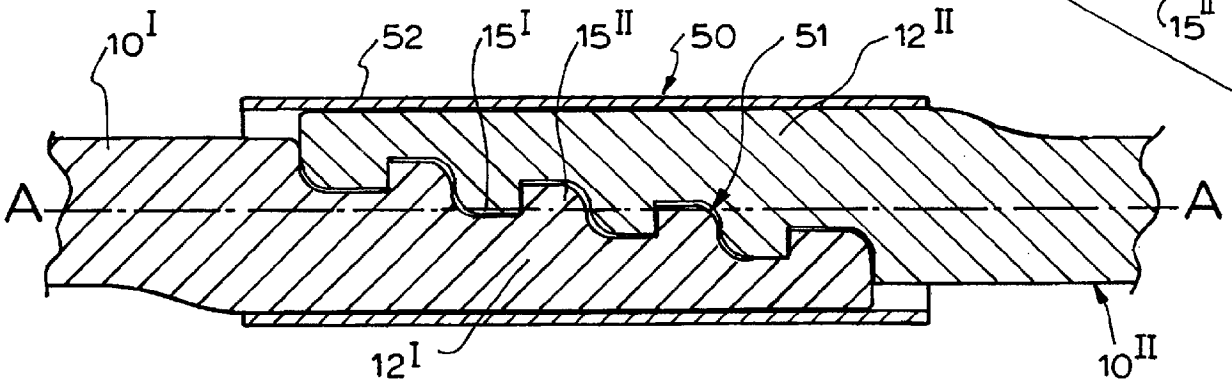
FIG. 6 is a sectional view of the coupling of FIG. 5.

Turning now to FIGS. 5 and 6, a coupling 50 is disclosed which is formed from interconnection of the termination 12 of one reinforcing bar with an identical termination of another like bar. For convenience in the following description of the coupling 50 one reinforcing bar is designated using superscript I whereas the other reinforcing bar includes superscript II with associated features given like designations.

The coupling 50 is formed by interconnecting the terminations $\mathbf{12}^{I}$ and $\mathbf{12}^{II}$ to form an interlock 51. With the upstands of one termination interfitting within corresponding recesses of the other termination. The interlock extends along an axis (designated A-A) which, in the illustrated form, is coaxial with the central axis of the respective reinforcing bars $\mathbf{10}^{I}$ and $\mathbf{10}^{II}$. Furthermore, once the terminations $\mathbf{12}^{I}$ and $\mathbf{12}^{II}$ are interconnected along their engagement faces $\mathbf{15}^{I}$ and $\mathbf{15}^{II}$ the exterior surface of the termination forms a complete cylinder (which in the illustrated form is a circular cylinder) having a diameter which is greater than the diameter of the respective shafts $\mathbf{11}^{I}$ and $\mathbf{11}^{II}$.

The coupling 50 also includes a retaining device 52 which is arranged to prevent separation of the terminations. In the illustrated form, the retaining device 51 is in the form of a sleeve, typically a metal sleeve having an internal bore which is just slightly larger than the exterior diameter of the cylinder formed by the interconnected terminations. In this way the sleeve can slide over the lapping terminations and is typically retained in place by a wire tie or the like.

In use, the reinforcing bars $\mathbf{10}^{I}$ and $\mathbf{10}^{II}$ are arranged to be embedded in concrete so as to accommodate load induced in the resulting structure. Typically there are two types of loading conditions. The first is axial loading which extends primarily in the direction of the bars axis CL. This axial loading may be in tension or in compression. The other loading condition is shear where the loading is in a direction normal to the centreline CL. The coupling 50 is arranged to accommodate loading in both these conditions as will be discussed in more detail below.

Under axial load, the reinforcing bars $\mathbf{10}^{I}$ and $\mathbf{10}^{II}$ may be biased apart (under tension) or biased together, with tensile loading being the predominant condition. This axial loading is accommodated by the coupling 50 through interengagement of the upstands in the two terminations $\mathbf{12}^{I}$ and $\mathbf{12}^{II}$. In particular, the upstands are arranged to engage along their bearing surfaces $\mathbf{29}^{I}$, $\mathbf{29}^{II}$ formed in the side walls. These form the regions of contact of the upstands under axial loading and in particular there are no points of contact between the transition regions 30, 31 because of the smaller radius of the top transition region 30 as compared to the lower transition region 31. Because the bearing surfaces $29^{I}$, $29^{II}$ are disposed normal to the direction of loading there is no vector force developed to load the surrounding sleeve 51. As such, this axial loading is fully contained within the terminations.

To accommodate the shear load, the retaining device 51 has a section modulus which is sufficient to accommodate the design shear loading. With this arrangement, it is not necessary to orientate the reinforcing bars so that shear is accommodated by the interlock.

Figure 7:
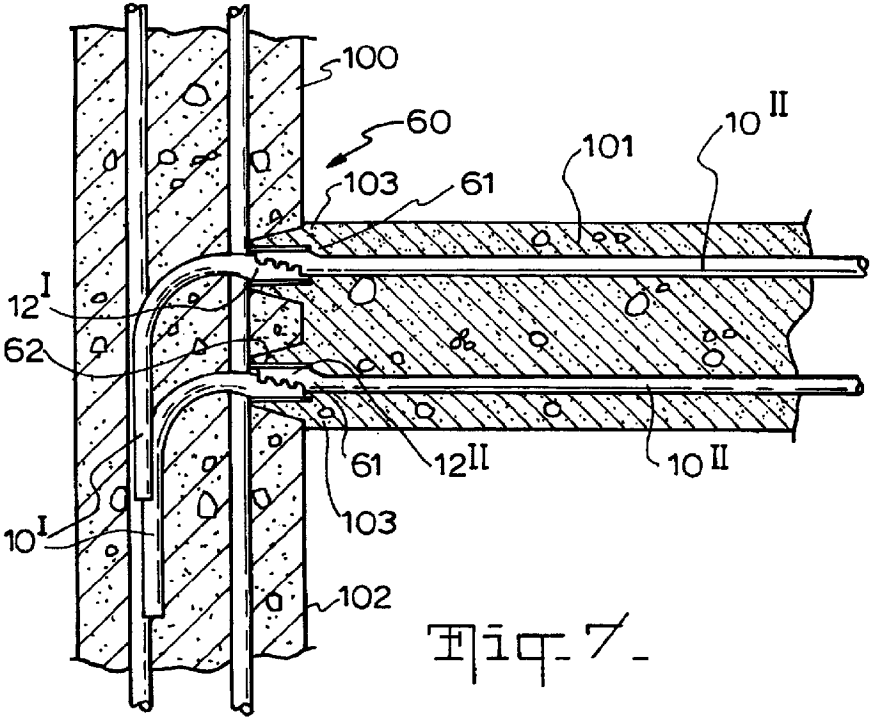
FIG. 7 is a sectional view of a variation of the coupling of FIG. 5 when installed as a shear connector.

FIG. 7 illustrates a shear coupling 60 which is a variation of the coupling 50. As the shear coupling includes the components of the coupling 50 described above for convenience like features have been given like reference numerals. Furthermore for ease of description, superscript is used to distinguish between the two reinforcing bars provided in the coupling 60.

The shear connector 60 is utilised to interconnect reinforcement from a wall 100 through to a slab 101. To form this connection, the wall 100 is constructed first and incorporates reinforcing bars $10^{I}$. Instead of extending solely in the plane of the wall 100, the reinforcing bars $10^{I}$ are turned so as to extend to a face 102 of the wall 100. The wall 100 is cast with recesses 103 that project in from the face 102 so as to expose the terminations $12^{I}$ and make those terminations accessible from the face 102 of the wall 100. In this way these terminations $12^{I}$ are ready to receive the reinforcing bars $10^{II}$ in the set up of the reinforcing for the slab 101.

In the illustrated form, the terminations $12^{I}$ $12^{II}$ are of a shorter length having only three upstands rather than the four upstands in the earlier embodiment. With this arrangement, the terminations $12^{I}$ do not protrude from the face 102 of the wall 100.

In setting up the reinforcing for the slab 101, the reinforcing bars $10^{II}$ can simply be connected to the reinforcing bars $10^{I}$ by forming an interlock 61 through interconnection of the termination $12^{II}$ with the terminations $12^{I}$. The sleeves 62 are then disposed over the interlocks to retain the terminations in engagement. Moreover the sleeves 62 have a section modulus which is sufficient to accommodate the design shear loading at the couplings 60.

Once the reinforcing has been connected, the concrete can then be poured to form the sleeve. In casting the concrete the recesses 103 are fully filled so as to ensure there is adequate cover over the reinforcing.

Figure 8:
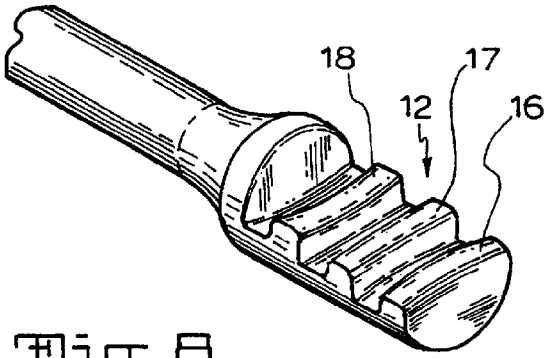
FIG. 8 is a perspective view of a variation of the reinforcing of FIG. 1 with a different engagement face profile.
Figure 9:
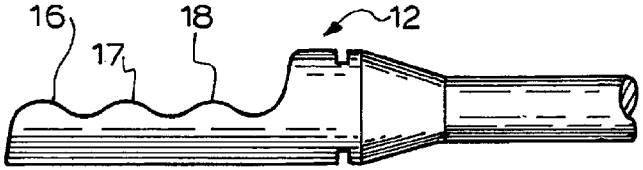
FIG. 9 is a side view of yet a further variation of the termination of FIG. 1.

FIGS. 8 and 9 show further variations on the profile of the terminations 12 disclosed above. Again as these terminations include many of the features described above like features have been given like reference numerals.

In the embodiment of FIG. 18, the upstands 16, 17 and 18 of the terminations 12 are of more complex design being arcuate rather than linear as in the earlier embodiments.

FIG. 9 illustrates yet a further variation on the profile of the termination 12. In this embodiment, the upstands are more undulating than in the earlier embodiments. In the embodiments of both FIGS. 8 and 9, the bearing surfaces formed in the side wall inclined from perpendicular to the direction of axial loading. This is particularly the case for the embodiment of FIG. 9. As such, in these embodiments, under axial loading there will be a transfer of force to the retaining device, although a majority of the load can be taken through the bar. Further, because of the shape of these upstands, it may be necessary to have a very tight tolerance between the terminations and the retaining device to minimise lateral slip. This tolerance can be formed by post forming of the retaining device or by the use of packing as described above.

Figure 10:
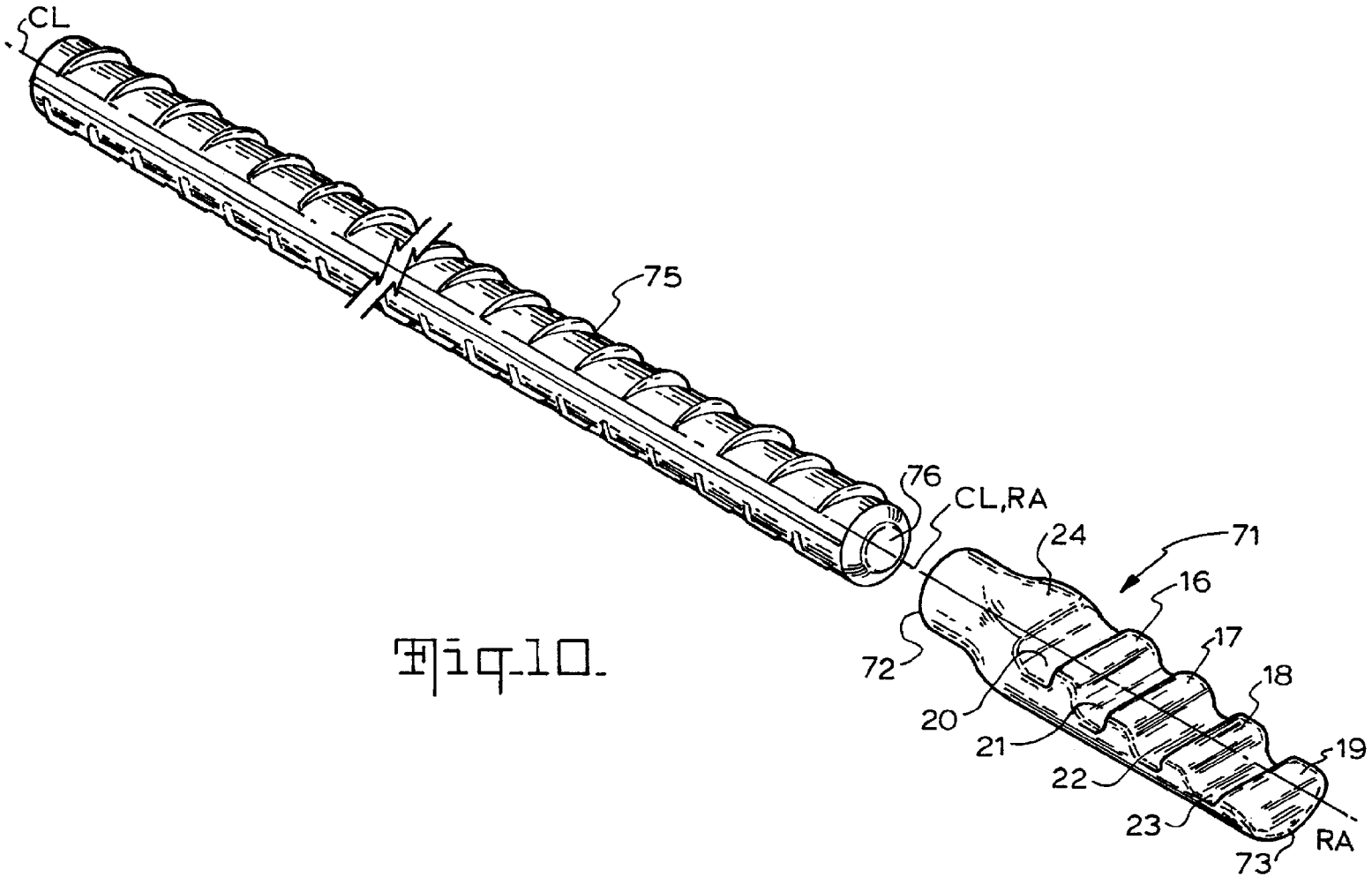
FIG. 10 is a perspective view of a cast termination and reinforcing bar.
Figure 11:
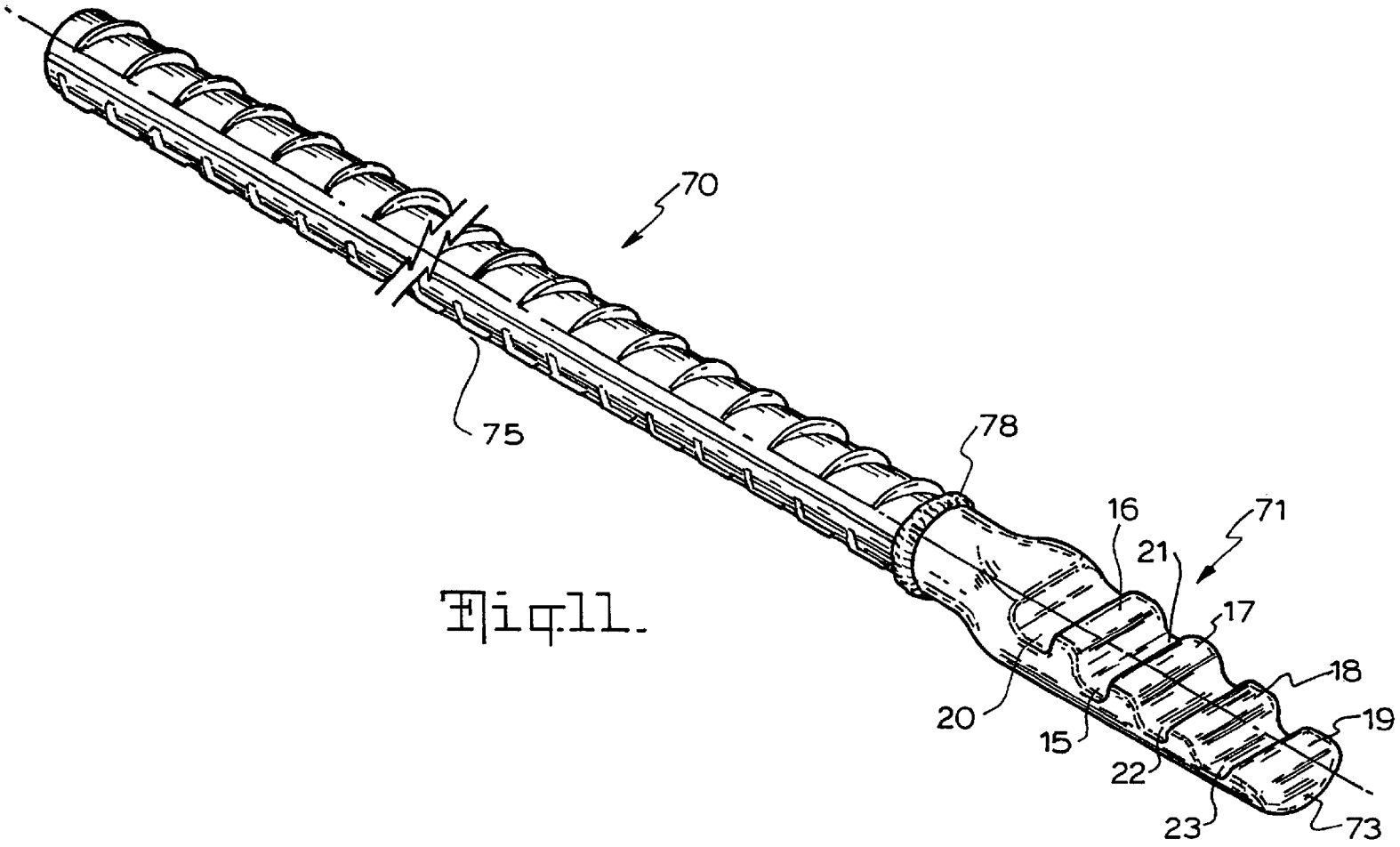
FIG. 11 is a perspective view of reinforcing formed by the bonding of the cast termination and reinforcing bar of FIG. 10.
Figure 12:
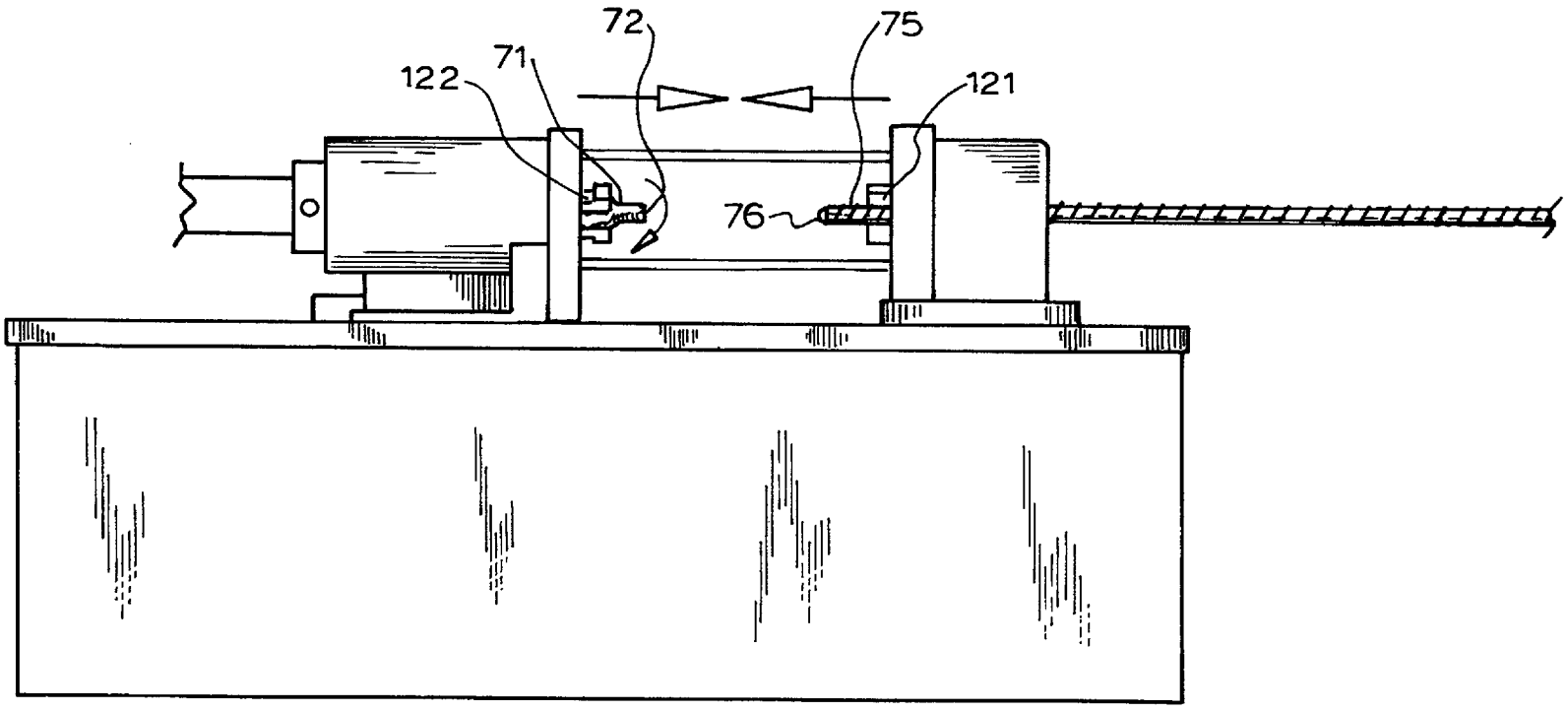
FIG. 12 is a schematic view of friction welding machine used to join the termination and reinforcing bar of FIG. 10.

FIGS. 10 to 12 show a further variation where reinforcing 70 is formed from two separate components; namely an end component (or termination) 71 and a length of conventional reinforcing bar 75 (shown as deformed bar). The termination 71 is profiled to include the lateral engagement face 15 and locking formations (16, 17, 18, 19, 20, 21, 22, 23) of the reinforcing bar 10 and for convenience like features have been given like reference numerals. The termination 71 is formed separate to the bar, and in a particular form is cast as a single piece. However, it is to be appreciated that the process of making the termination is not limited to casting and it may be formed by other material working techniques such as forging, milling, pressing and like or by a combination of those processes.

The termination includes a first and second end (72, and 73), with the first end 72 being in use joined to an end 76 of the reinforcing bar 75. In the illustrated form, the diameter of the first end 72 is generally the same size as the diameter of the bar 75 so that when joined there is a consistent connection bond 78 between those components in the reinforcing 70 (as shown in FIG. 11). This connection bond 78 in the illustrated form is substantially perpendicular to the axis of the reinforcing bar CL. As such the bond is perpendicular to the principal loading condition (axial) of the reinforcing.

In forming the reinforcing 71, the join 78 between the termination and the reinforcing bar is made permanent. This has the advantage of making the reinforcing a fully integral unit that obviates the need for any manual assembly of components on site. This both provides for ease of installation and obviates the problem of incorrect fitting of separate couplings. It also allows the join to be made in an environment where the properties of the join can be controlled to ensure they are satisfactory. Furthermore, bonding of the components, rather than using a mechanical connection such as a collar swaged onto both components, minimise the components used in the connection, and allows for better control of the join to ensure that the requirements of strength under axial load and ductility are met.

In a particular form, the termination and bar are connected by a friction welding process where the two components are forced together (under a friction or forge force) and are heated by mechanical friction of one component rubbing against the other (in the illustrated form of FIG. 12 by rotating one component whilst holding the other component stationary). In particular, the bar 75 is held in a non rotating chuck 121 of a friction welding machine 120, whilst the termination 71 is attached to a rotating chuck 122. The components 71, 75 are aligned so that the axis CL of the bar 75 aligns with a reference axis RA of the termination 71. The component ends 72, 76 are brought together by relative movement of the chucks 121 and 122 and the chuck 122 is rotated to cause the termination end 72 to rub against the bar end 76 causing the components to heat. The heating by mechanical friction continues for sufficient time until the metal softens and some shortening (upset) of the components occur under the friction force. The rotation driving force on the chuck 122 is then discontinued but the friction force is maintained or increased to fuse the termination to the bar end 76. Technically, because no melt occurs, friction welding is not actually a welding process in the traditional sense, but a forging technique. The resulting join is of forge quality and is a complete butt joint weld through the contact area. The friction welding machine requires no special installation requirements, there are no gases generated that need to be exhausted, and the process is easily automated for high production rates. A further advantage is that the ends to be joined do not need to be specially prepared thereby minimising pre-treatment of the components 71, 75.

A coupling arrangement using the reinforcing bars 10 or reinforcing 70 as described above has substantial practical benefit. As each termination is permanently joined to the bar shaft, the strength of the termination can be properly matched to the strength of the bar, particularly where the termination is formed from the same material as the bar shaft. A major problem with prior art couplers that use separate components is the fact that the reinforcing bar may vary in strength (e.g. nominally 500 MPa/bar may have an allowed top strength of 650 Mpa). This means that couplers may be mismatched with extremely strong bars so the couplers need to be made to accommodate this possible mismatch. This can have attendant problems as it may reduce the ductility properties of the coupler itself by providing a coupler of higher strength than required. The integral nature of the termination to the shaft obviates this mismatch and allows for ductility and strength to the joint to be correctly matched to the bar shaft.

Typically by incorporating an enlarged end with the profiled engagement face and having the material of the termination the same as the shaft, the strength at the coupling is greater than the bar being joined. In one form, the coupling has a strength of approximately 110% of the strength of the bar although as will be appreciated this could be varied by varying the dimensions of the various components in the termination.

Even with this increased strength, the coupling exhibits greater ductility than the bar shaft and tests conducted by the inventor has shown this to be the case. Without being bound by theory, this ductility increase has shown to be found as under plastic deformation the upstands tend to collapse which allows elongation along the coupling.

Also, the normal bearing faces limit the longitudinal slip of the coupling under load. Again tests conducted by the inventor have indicated that there is slip of less than 0.1 mm under prescribed loading test conditions (typically under 300 Mpa of axial loading). A feature of having the bearing faces normal to the direction of axial loading is that the slip is not dependent on the fit between the sleeve 51 and the coupled terminations. With this arrangement, the sleeve does not need to be manufactured to a precise tolerance.

Further, the coupling has a relatively thin profile which is advantageous as it may allow thinner concrete sections to be used in some circumstances whilst still allowing adequate concrete cover to provide over the reinforcing.

Finally, an advantage of the coupling is that it is easy to assemble onsite and easy to ascertain onsite whether the coupling has been properly installed. If the terminations have not been properly connected together, then it may not be possible to locate the sleeve over the coupled terminations and/or it is clearly visible as part of a termination projects beyond the sleeve length.

The option of preforming the terminations and then subsequently joining those terminations to reinforcing bars, enables the resultant reinforcing to be made without the need for highly specialised equipment, thereby providing flexibility in the manufacture of the product and in particular allows for distributed manufacturing which can reduce transporting and handling costs, and if desired on site manufacture.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

Variations and modifications may be made to the parts previously described without departing from the spirit or ambit of the invention.

The invention claimed is:

1. A reinforcing bar comprising a shaft extending along a portion of the length of the bar and a termination extending along an end portion of the bar, the termination incorporating an engagement face incorporating locking formations thereon arranged to interfit with a complementary shaped termination to form an interlock arranged to accommodate axial loading, the locking formations comprising a plurality of spaced apart upstands extending transversely across the engagement face, and a plurality of recesses disposed between adjacent ones of the upstands, wherein, in use the upstands and recesses interfit with upstands and recesses disposed on the complementary shaped termination, wherein to facilitate proper mating of the terminations in forming an interlock an end upstand adjacent a terminal end of the bar is wider than the other upstands and an innermost recess is wider than the other recesses to receive an upstand of the shape of the end upstand.

2. The reinforcing bar according to claim 1, wherein each upstand has a side wall extending between a bridging portion of the upstand, and a base portion of an adjacent recess.

3. The reinforcing bar according to claim 2, wherein each side wall incorporates a bearing surface which is arranged to engage the complementary shaped termination in the interlock.

4. The reinforcing bar according to claim 3, wherein each side wall includes a first transition region formed above the bearing surface and forms the intersection between the bearing surface and the bridging portion; and a second transition region extends from the bearing surface to the base portion, the side walls are configured so that the bearing surfaces of the upstands form the regions of contact in the interlock to accommodate loading applied in the longitudinal direction with no points of contact formed at the transition regions.

5. A termination for a reinforcing bar, the termination having a body extending in a longitudinal direction between opposite first and second ends, and an engagement face formed on the body, in use the first end is joined to an end of a reinforcing bar, and the engagement face incorporates locking formations thereon arranged to interfit with a complementary shaped termination to form an interlock arranged to accommodate loading applied in the longitudinal direction, the locking formations comprising a plurality of spaced apart upstands extending transversely across the engagement face, and a plurality of recesses disposed between adjacent ones of the upstands, wherein, in use, the upstands and recesses interfit with upstands and recesses disposed on the complementary shaped termination, wherein to facilitate proper mating of the terminations in forming an interlock an end upstand adjacent a terminal end of the bar is wider than the other upstands and an innermost recess is wider than the other recesses to receive an upstands of the shape of the end upstand.

6. The termination for a reinforcing bar according to claim 5, wherein the termination is formed as a metal casting.

7. The termination for a reinforcing bar according to claim 5, wherein the termination is shaped to form part of a reinforcing coupling and arranged to form an interlock with a complementary termination of identical shape to said termination.

8. The termination for a reinforcing bar according to claim 5, wherein the locking formations are shaped so that the reaction force at the interlock under axial loading does not induce separation of the terminations.

9. The termination for a reinforcing bar according to claim 5, wherein each upstand has a side wall extending between a bridging portion of the upstand, and a base portion of an adjacent recess.

10. The termination for a reinforcing bar according to claim 9, wherein each side wall incorporates a bearing surface which is arranged to engage the complementary shaped termination in the interlock.

11. The termination for a reinforcing bar, the termination having a body extending in a longitudinal direction between opposite first and second ends, and a lateral engagement face formed on the body, in use the first end is joined to an end of a reinforcing bar, and the engagement face incorporates locking formations thereon arranged to interfit with a complementary shaped termination to form an interlock arranged to accommodate loading applied in the longitudinal direction, wherein the locking formations comprise one or more upstands extending transversely across the engagement face and at least one recess disposed adjacent to at least one of the upstands, wherein, in use, the at least one upstand and the at least one recess interfit with at least one upstand and at least one recess disposed on the complementary shaped termination, wherein each upstand has a side wall extending between a bridging portion of the upstand, and abase portion of an adjacent recess, wherein each side wall incorporates a bearing surface which is arranged to engage the complementary shaped termination in the interlock, wherein each side wall includes a first transition region formed above the bearing surface and forms the intersection between the bearing surface and the bridging portion; and a second transition region extends from the bearing surface to the base portion, the side walls are configured so that the bearing surfaces of the upstands form the regions of contact in the interlock to accommodate loading applied in the longitudinal direction with no points of contact formed at the transition regions.

12. Reinforcing comprising: a reinforcing bar extending along a portion of the length of the reinforcing; and a termination extending along an end portion of the reinforcing, the termination having a body extending in a longitudinal direction between opposite first and second ends, and a lateral engagement face formed on the body, the engagement face incorporates locking formations thereon arranged to interfit with a complementary shaped termination to form an interlock arranged to accommodate loading applied in the longitudinal direction, and wherein the termination is permanently bonded to the reinforcing bar, wherein the locking formations comprise one or more upstands extending a the upstands, wherein, in use, the at least one upstand and the at least one recess interfit with at least one upstand and at least one recess disposed on the complementary shaped termination, wherein each upstand has a side wall extending between a bridging portion of the upstand, and a base portion of an adjacent recess and wherein each side wall incorporates a bearing surface which is arranged to engage the complementary shaped termination in the interlock and wherein each side wall includes a first transition region formed above the bearing surface and forms the intersection between the bearing surface and the bridging portion; and a second transition region extends from the bearing surface to the base portion, the side walls are configured so that the bearing surfaces of the upstands form the regions of contact in the interlock to accommodate loading applied in the longitudinal direction with no points of contact formed at the transition regions.

13. The reinforcing according to claim 12, wherein the first end of the termination is permanently bonded to an end of the reinforcing bar so that the termination and the reinforcing bar are joined in end to end relation.

14. The reinforcing according to claim 12, wherein a reference axis of the termination that extends between the first and second ends is aligned with an axis of the reinforcing bar.

15. The reinforcing according to claim 12, wherein the termination is friction welded to the shaft.

16. The reinforcing according to claim 12, wherein a first said upstand is wider in the longitudinal direction than a second said upstand.

17. A coupling for interconnecting first and second reinforcing bars, the coupling comprising:

first and second reinforcing bars, each reinforcing bar comprising a shaft extending along a portion of the length of the bar and a termination extending along an end portion of the bar, the termination incorporating an engagement face incorporating locking formations thereon arranged to interfit with a complementary shaped termination to form an interlock arranged to accommodate axial loading, the locking formations comprising a plurality of spaced apart upstands extending transversely across the engagement face, and a plurality of recesses disposed between adjacent ones of the upstands, wherein, in use, the upstands and recesses interfit with upstands and recesses disposed on the complementary shaped termination, wherein to facilitate proper mating of the terminations in forming an interlock an end upstand adjacent a terminal end of the bar is wider than the other upstands and an innermost recess is wider than the other recess to receive an upstand of the shape of the end upstand, the engagement faces of the terminations of the first and second reinforcing bars being in opposing abutting relation with the locking formations of those terminations interfitting to form an interlock, and a retaining device disposed around the interlock to retain the engagement faces in the opposing abutting relation to one another.

18. The coupling according to claim 17, wherein the interlock extends along an axis and the locking formations are shaped so that the interlocks accommodate loading in the direction of that axis without inducing loading on the retaining device.

19. The coupling according to claim 17, wherein the retaining device is in the form of a sleeve.

20. The coupling according to claim 17, wherein the terminations of the first and second reinforcing bars are of identical shape.

21. The reinforcing bar according to claim 1, wherein the bearing surfaces extend at an angle of within 10° of the perpendicular to the direction of interlock axis and more preferably within 5° of the perpendicular.

22. The reinforcing bar according to claim 1, wherein the upstands are stepped downwardly along the engagement face towards the terminal end of the bar.

* * * * *